United States Patent [19]

Deters

[11] 4,131,140

[45] Dec. 26, 1978

[54] AUTOMATIC FLUID DISPENSING APPARATUS

[75] Inventor: Elmer M. Deters, Muscatine, Iowa

[73] Assignee: Wylain, Inc., Dallas, Tex.

[21] Appl. No.: 865,186

[22] Filed: Dec. 28, 1977

[51] Int. Cl.[2] ..... B65B 3/26

[52] U.S. Cl. ..... 141/206; 141/22 S

[58] Field of Search ..... 141/192–229, 141/285–295, 301, 302, 93

[56] References Cited

U.S. PATENT DOCUMENTS

| | | | |
|---|---|---|---|
| 3,341,075 | 9/1967 | Boudot et al. | 141/209 |
| 3,521,680 | 7/1970 | Wood et al. | 141/209 |
| 3,739,945 | 6/1973 | Moore et al. | 141/206 |
| 3,866,636 | 2/1975 | Lasater | 141/22 S |
| 3,900,056 | 8/1975 | Giardini et al. | 141/290 |

*Primary Examiner*—Houston S. Bell, Jr.
*Attorney, Agent, or Firm*—Lane, Aitken & Ziems

[57] ABSTRACT

An apparatus for dispensing fluid into a container in which a first passage is formed in a housing for permitting direct flow of fluid from an inlet to an outlet associated with the housing and a second passage receives a portion of the fluid and includes an eductor for creating a vacuum in the housing. A valve member is disposed in the housing and is normally biased into a closed position to close the passage. A manually operable lever is adapted to open the valve member and is controlled by a linkage mechanism responsive to the vacuum. A diaphragm seal is associated with the valve member for preventing leakage of fluid through the valve mechanism.

17 Claims, 11 Drawing Figures

AUTOMATIC FLUID DISPENSING APPARATUS

BACKGROUND OF THE INVENTION

This invention relates to fluid dispensing apparatus and more particularly to such an apparatus which automatically shuts off after a predetermined fluid level is achieved in the container to be filled.

Automatic dispensing nozzles of the type which automatically close when the container being filled reaches a predetermined level are known and are widely used, for example, in service stations for supplying gasoline to vehicle tanks. In these installations, the nozzles are normally arranged to be manually latched to an open position and to automatically close when the gasoline tank is substantially filled.

In one form of automatic shut-off dispensing nozzle, a venturi effect is created by the passage of the fluid through the nozzle housing which operates a diaphragm or the like for controlling an automatic trip mechanism. However, in these type of arrangements, the venturi can only produce a relatively low amount of vacuum which renders the unit relatively insensitive. This is particularly disadvantageous since in these type of mechanisms the automatic trip is usually obtained through the action of a sliding rod corporating with rolling balls or the like which selectively release same in response to the movement of the diaphragm, which is a fairly complicated arrangement requiring a relatively large amount of vacuum to cause the tripping.

Also in these type mechanisms, a mechanical packing is normally provided on the main poppet valve stem which requires a fairly large spring pressure to bias the valve to a closed position. This pressure, of course, requires a corresponding large amount of counter-pressure on the manually actuatable lever engaged by the operator, which makes the nozzle difficult to operate.

SUMMARY OF THE PRESENT INVENTION

It is therefore an object of the present invention to provide an automatic dispensing apparatus which is very sensitive in its response to the filling of the vehicle tank or other container to be filled.

It is a further object of the present invention to provide an apparatus of the above type in which a relatively high efficiency is achieved by an educator to operate the shut off mechanism.

It is a further object of the present invention to provide an apparatus of the above type which incorporates a relatively simple latching and tripping mechanism for operating the automatic shut off mechanism.

Toward the fulfillment of these and further objects, the apparatus of the present invention comprises a housing for permitting the flow of fluid from an inlet to an outlet. The housing includes a first passage for permitting a direct flow of fluid from the inlet to the outlet and a second passage for receiving a portion of the fluid passing from the inlet to its outlet. An eductor is provided in the second passage for creating a vacuum zone in the housing in response to the flow of fluid through the second passage. A valve member is disposed in the housing and is normally biased into a position to close the passages and is movable in said housing to open the passages. A lever assembly is movable relative to the housing between a first position in which it can be manually actuated to move the valve member into its passage-opening position and a second position in which it cannot be manually actuated to move the valve member into its passage-opening position. A linkage mechanism is disposed in the housing in engagement with the lever assembly for exerting a first force against the lever assembly to urge same to its first position, and means responsive to the creation of said vacuum zone is provided for exerting a second force against the lever assembly greater than the first force to urge the lever assembly to its second position. Means are provided in the housing for sensing the absence of a prdetermined fluid level in the container to be filled for relieving the vacuum and the second force so that the lever assembly is urged to its first position.

BRIEF DESCRIPTION OF THE DRAWINGS

The above brief description, as well as further objects, features, and advantages of the present invention will be more fully appreciated by reference to the following detailed description of a presently preferred but nonetheless illustrative embodiment in accordance with the present invention, when taken in connection with the accompanying drawings wherein.

DESCRIPTION OF THE PREFERRED EMBODIMENTS

Figure 1:
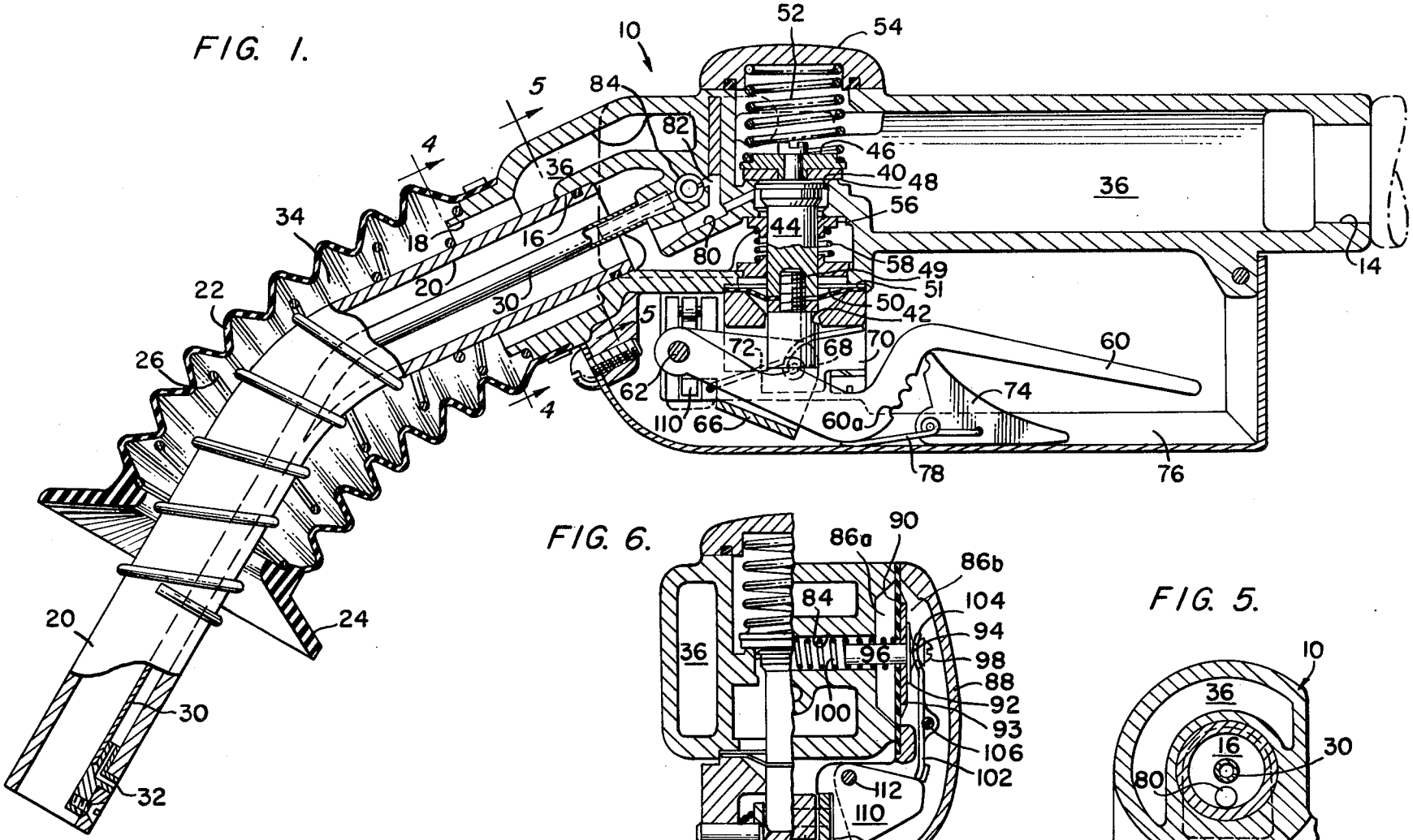
FIG. 1 is a cross-sectional view of the fluid dispensing apparatus of the present invention.
Figure 2:
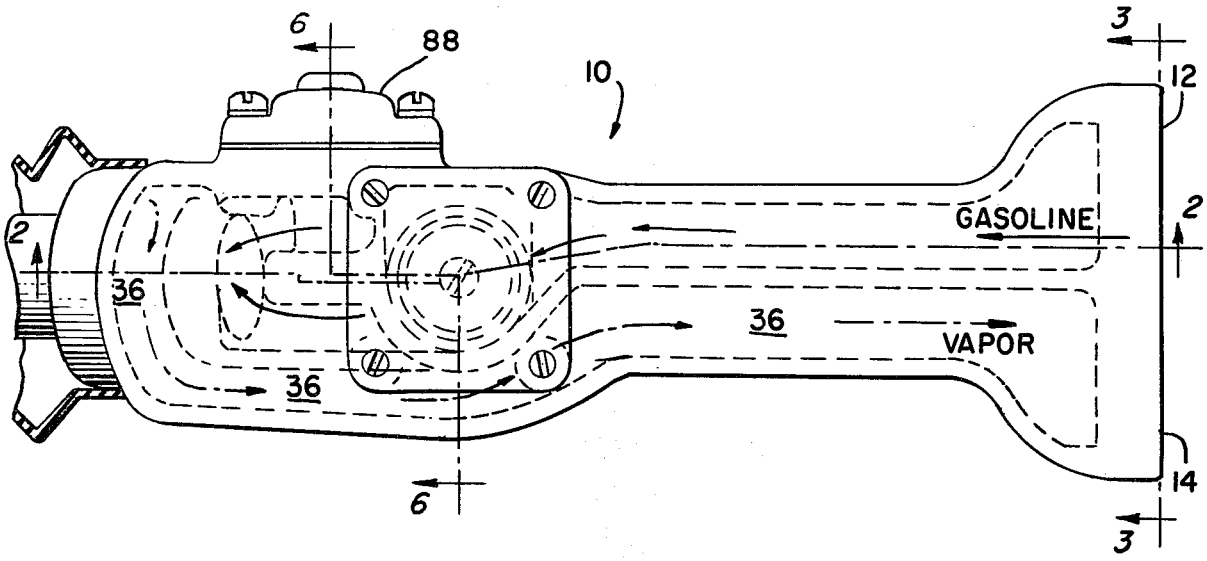
FIG. 2 is a partial top plan view of the apparatus of FIG. 1.
Figure 3:
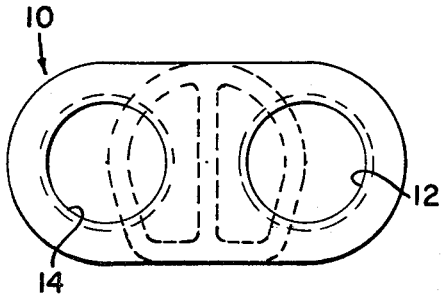
Figure 4:
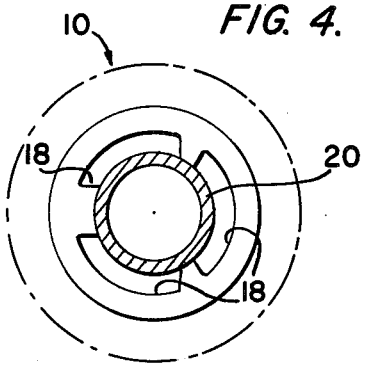

Referring specifically to FIGS. 1–3 of the drawings, the reference 10 refers to a housing having a series of partitions and walls to define a juxtapositioned gasoline inlet 12 and vapor outlet 14 formed at one end thereof and a gasoline outlet 16 and a plurality of arcuate shaped vapor inlets 18 disposed at the other end. A discharge spout 20 is attached to the housing 10 in registry with the gasoline outlet 16 and an annular enveloping bellowstype sleeve 22 surrounds the discharge spout 20 and is connected at one end to the housing 10. A tank fill collar 24 is mounted at the other end of the sleeve 22 and is urged outwardly by a coil spring 26 which extends around the discharge spout 16 and engages an inner shoulder formed on the collar 24. The sleeve 22 is preferably formed of a gasoline-resistant synthetic rubber, or the like, so that when the spout 20 is inserted into a fill tank (not shown) of a vehicle or the like, the spring 26 and the sleeve 22 are compressed to ensure a seal at the interface between the spout of the fill tank and the discharge spout 20. It is understood that separate hoses from a dispensing pedestal, or the like, will be attached to the housing 10 is registery with the gasoline inlet 12 and the vapor outlet 14, in a conventional manner.

A fluid detecting air conduit 30 is provided which extends from an opening 32 in the wall of the spout 20 to the interior of the housing 10 for sensing or detecting the presence of fluid at a predetermined level in the fill tank, for reasons to be explained in detail later.

Figure 5:
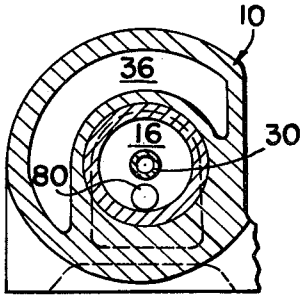
FIGS. 4 and 5 are cross-sectional views taken along the lines 4—4 and 5—5 respectively of FIG. 1.

An annular passage 34 is defined between the sleeve 22 and the spout 20 and communicates with the vapor inlets 18 for permitting vapor from the vehicle fill tank to pass into the interior of the housing 10. As noted from an inspection of FIGS. 1–6, a through passage, referred to in general by the reference numeral 36 is defined in the housing and communicates at one end with the vapor inlets 18 and at its other end with the vapor outlet 14. As noted in particular in FIG. 2, the passage 36 extends along one side of the housing 10 near the inlets 18, passes across the housing (as also shown in FIG. 5) and then extends along the other side of the housing near the outlet 14.

Referring again to FIG. 1, a valve seat 40 is formed in the interior of the housing 10 by an appropriately shaped internal partition, with the seat being in the path of fluid flow from the gasoline inlet 12 to the outlet 16. A bore 42 is defined in the housing by an appropriate shaped wall member and extends in a coaxial relationship to the valve seat 40 and in a spaced relationship thereto.

A poppet valve stem 44 is disposed for slidable movement in the bore 42 and a valve head 46 is disposed on the upper end of the stem 44 as viewed in FIG. 1, and supports a gasket 48 adapted to seat on the valve seat 40. The stem 44 is formed by two portions connected by a threaded bolt 49, with a membrane 50 extending between the abutting surfaces of the two portions. The outer periphery of the membrane 50 extends between two corresponding abutting surfaces defined within the housing 10 and has a central opening therein for receiving the bolt 49. A gasket 51 also extends between the latter abutting surfaces, in engagement with the membrane 50.

A spring 52 is disposed in the housing 10 and extends immediately under a removable cap 54 for exerting a force against the upper surface of the valve head 46 to urge the gasket 48 into engagement with the valve seat 40 to normally prevent the flow of gasoline from the inlet 12 to the outlet 16. A relief valve 56 is mounted on the valve stem 44 and is urged by a spring 58 into engagement with an appropriately formed shoulder defined by the aforementioned internal partition. The specific function of the relief valve will be described later.

Figures 7, 8:
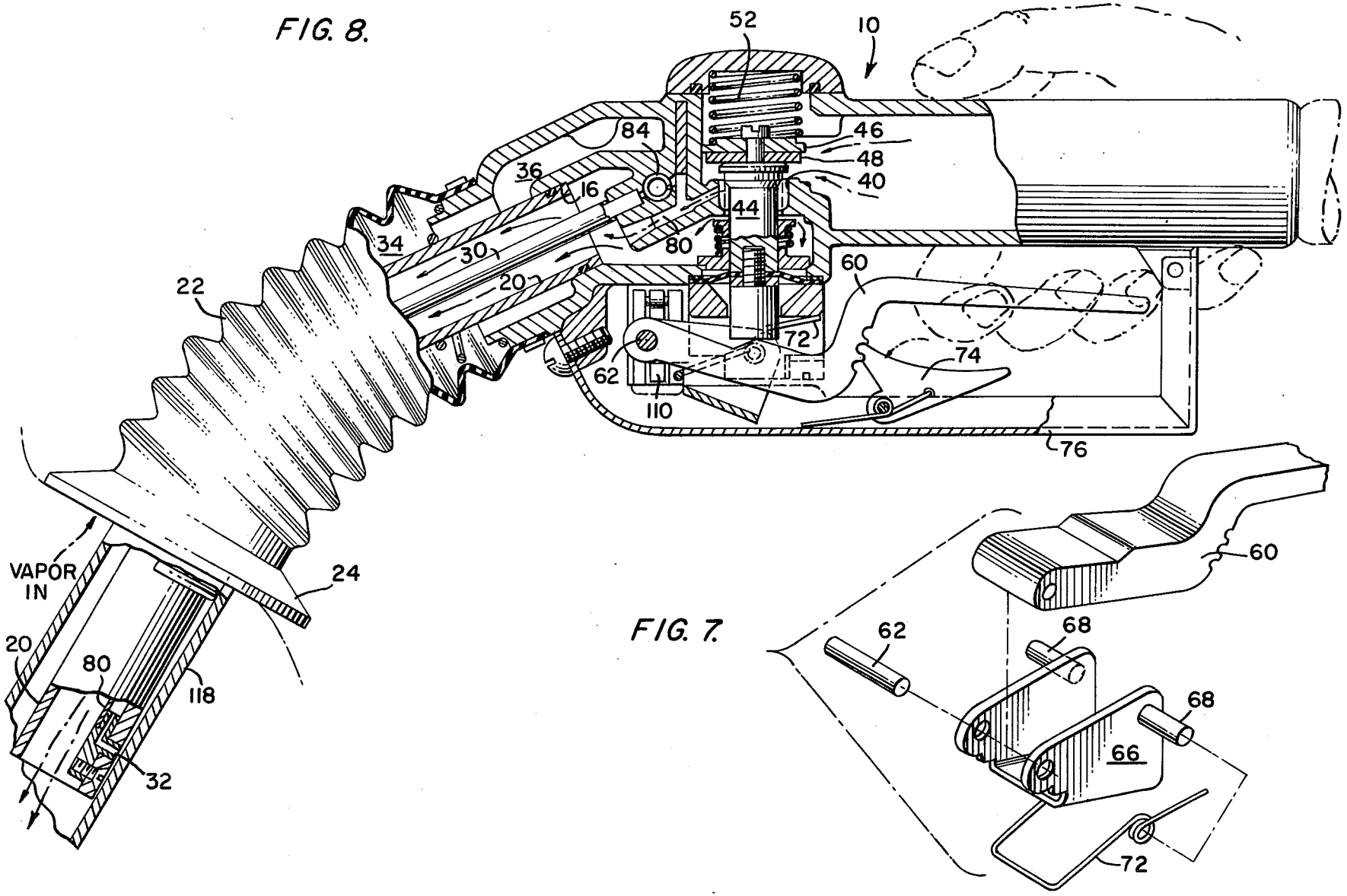
FIG. 7 is an exploded perspective view of a component of the apparatus of FIGS. 1–6.
FIGS. 8 and 9 are views similar to FIG. 1 but showing the apparatus of the present invention in different operational modes.

As better shown in FIGS. 1 and 7, an actuating lever 60 is pivotally mounted about a pin 62 which is secured at its ends to a subhousing 66 enclosing a portion of the lever 60. The subhousing 66 is pivotally mounted relative to the housing 10 by a pair of pins 68 extending outwardly from the subhousing and within depending flanges 70 extending from the housing 10. A leaf spring 72 extends around the subhousing 66 and the lever 60 and abutts against the lower portion of the housing 10 to normally urge the subhousing 66 and therefore the lever 60 into the position shown in FIG. 1.

A latch member 74 is pivotally mounted relative to a guard 76 supported by the housing and extending around the actuating lever 60. The latch member 74 is urged by a leaf spring 78 into the position shown in FIG. 1, and is adapted to be manually placed in one of a series of notches **60*a* formed in the lever 60** to lock the lever in a predetermined gasoline dispensing position, as will be described in detail later.

The actuating lever 60 is adapted to be manually pivoted about the pin 62 from the position shown in FIG. 1 to a position in which it engages and moves the valve stem 44 upwardly into the bore 42 to disengage the gasket 46 from the valve seat 40 and thus permit the passage of gasoline through the valve seat. As a result, gasoline can pass from the inlet 12, through the housing 10 and the outlet 16 into and through the discharge spout 20 into the tank to be filled.

A passage 80 is defined in a boss formed in the central portion of the housing 10 downstream of the valve seat 40, and is in communication with the valve seat to receive a portion of the flow passing through the housing. The passage 80 has a flared outlet portion as shown in FIG. 1 and forms an eductor which creates a vacuum zone in response to the fluid passing therethrough. A vertical passage 82 (FIG. 1) and a transverse passage 84 (FIGS. 1 and 6) are also formed in the aforementioned boss in the housing 10 and communicate the passage 80 with a chamber formed in part by a cap 88 extending over a complementary shaped well formed in the housing 10, as better shown in FIG. 6. A membrane 90 is supported along its outer peripheral portion by appropriately formed surfaces of the housing 10 and the cap 88 and extends across the latter chamber to divide same into two portions **86*a* and 86*b*. The membrane 90 is engaged and supported by a pair of abutting discs 92 and 93 having threaded rods 94 and 96, respectively, extending in opposite directions therefrom. A threaded bolt 98 extends in threaded engagement with internal bores formed within the rods 94 and 96 to secure the discs 92 and 93 together. The membrane 90 abutts the disc 93 and the rod 96** extends through an opening in the membrane.

Figure 6:
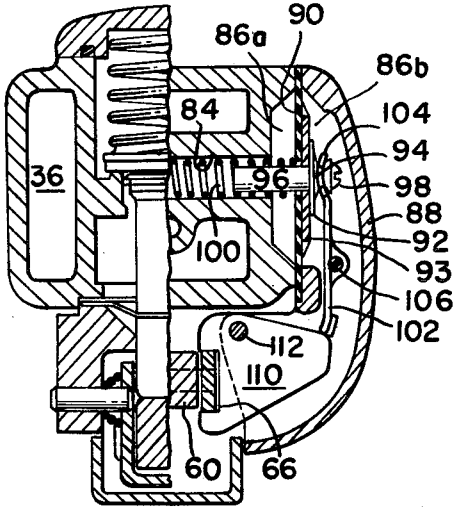
FIGS. 3 and 6 are cross-sectional views taken along the lines 3—3 and 6—6 respectively of FIG. 2.

A spring 100 is provided in the transverse passage 84 and extends around the rod 96 for normally urging the membrane 90 outwardly, as viewed in FIG. 6, against the force applied by the vacuum from the passage 84. It is noted with reference to FIG. 1, that the conduit 30 communicates the passage 84 with the vehicle fill tank which, under certain conditions to be explained later, relieves the vacuum in the passage 84 and therefore the chamber **86*a***.

A link 102 is disposed in the chamber portion **86*b* and has a slotted head portion 104 extending over an enlarged end portion of the rod 94. The link 102 is adapted for pivotal movement about a pin 106 mounted relative to the inner surface of the cap 88. The other end portion of the link 102 is doubled back as shown for engagement with a bell crank lever 110 which is pivotally mounted about a pin 112 secured to a lower extension of the cap 88. A notch is formed in the lever 110 for engaging the end of the subhousing 66 to which the lever 60 is mounted to retain the subhousing and therefore the lever in the position shown in FIG. 1**.

It is noted from FIG. 6 that the double-back end portion of the link 102 is adapted to engage the lever 110 to maintain same in the locking position described above. However, when the negative pressure applied to the chamber **86*a* via the passages 80, 82 and 84 is greater than the force exerted by the spring 100 against the membrane 90, the membrane will move from right to left as viewed in FIG. 6 causing the doubled-back end portion of the link 102 to move from left to right and release its locking engagement with the lever 110 and therefore the engagement of the latter with the subhousing 66 and the lever 60**.

It is also noted from FIG. 1 that the tube 30 extending through the discharge spout 20 will normally relieve the vacuum in the chamber **86*a*** as long as the fluid level in the container to be filled does not extend to the opening 32. As a result the force of the spring 100 maintains the lever 110 in the above-described locking position as shown in FIG. 6.

The dispensing apparatus of the present invention is shown in its inoperative, or closed, position in FIG. 1, i.e., when the flow of gasoline from the inlet 12 to the outlet 16 of the housing is blocked. To dispense the gasoline, the operator grasps the housing 10 in the appropriate manner shown in FIG. 8, i.e. with one or more fingers extending over the actuating lever 60, and places the discharge spout 20 in the container to be filled. In the case of an automobile vehicle, the spout is inserted into the fill tank of the vehicle until the collar 24 engages a corresponding fill spout formed on the vehicle tank and shown by the reference numeral 118 in FIG. 8 to establish a seal as discussed above.

The operator then engages the actuating lever 60 and pivots same about the pin 62 which is maintained in the position shown by the lever 110, until the lever 60 attains an appropriate position shown in FIG. 8. This action causes a portion of the lever 60 to engage the bottom end of the poppet valve stem 44 and urge same upwardly to a position where the gasket 48 associated with the poppet valve head 46 clears the valve seat 40 to permit gasoline from a hose connected to the inlet 14 to pass through the valve seat. A portion of the gasoline flows directly through the passage 80 and the remaining portion acts against the relief valve 56 and, when of a sufficient pressure to overcome the force of the spring 58, force the valve downwardly to permit flow through the valve seat 40 and the interior of the housing 10 before discharging from the outlet 16, through the spout 20, and into the vehicle tank.

The portion of the gasoline flowing through the passage 80 in the foregoing manner also passes through the interior of the housing 10 and discharges from the outlet 16, through the spout 20, and into the vehicle tank. The flow of this gasoline through the passage 80 creates a vacuum zone that is transmitted via the passages 82 and 84 to the chamber 86*a*. However, if the level of gasoline in the tank to be filled has not risen to an extent that it covers the opening 32 in the spout 20, the vacuum is relieved through the tube 30 which extends to the passage 84. As a result, the force of the spring 100 urges the link 102 to the position shown in FIG. 6 in which the link maintains the lever 110 in the position shown to lock the end of the actuating lever 60 in the position shown in FIGS. 1 and 8.

During this passage of fluid through the housing 10, vapor from the vehicle tank is forced through the annular space 34 between the sleeve 22 and the spout 20. As a result, the vapor passes through the passage 36 in the manner described above before exiting out the vapor outlet 12 and through a suitable hose for passage back into the storage tank or the like for further treatment.

Figure 10:
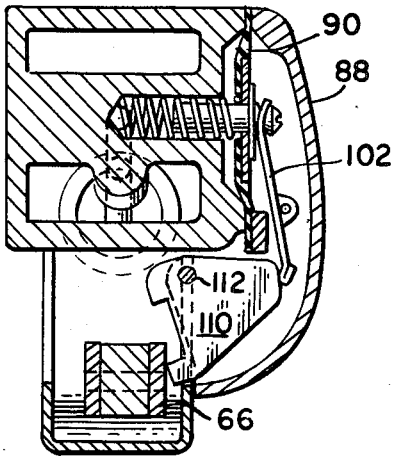
FIG. 10 is a cross-sectional view taken along the line 10—10 of FIG. 9.
Figures 9, 11:
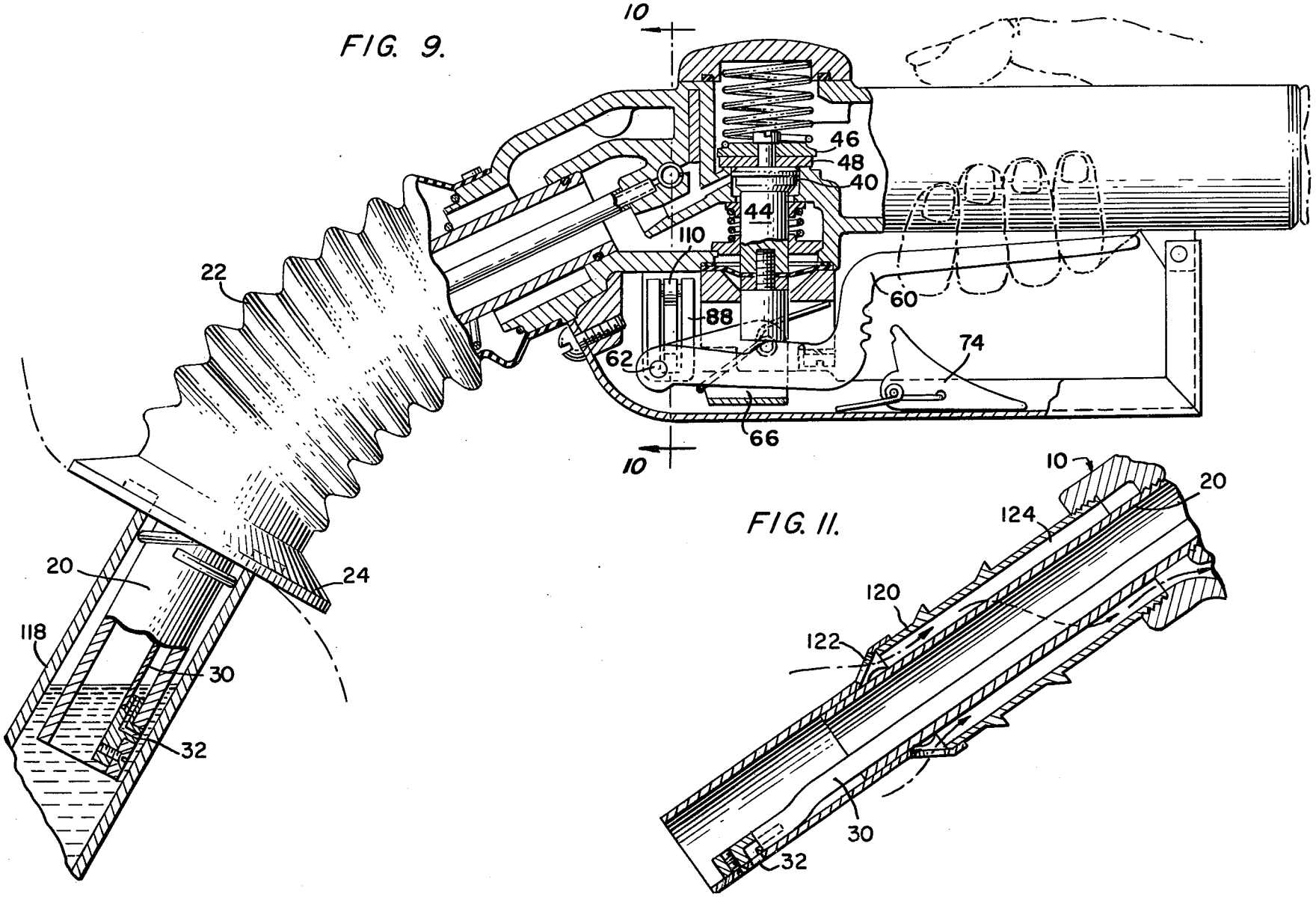
FIG. 11 is a partial sectional view depicting an alternate embodiment of a component of the apparatus of the present invention.

As soon as the level of the gasoline in the tank to be filled extends over the opening 32 in the spout 20 as shown in FIG. 9, the vacuum in passages 80, 82 and 84 is no longer relieved and is sufficient to overcome the force of the spring 100 so that the membrane 90 and therefore the link 102 moves under the force of the spring 52 acting through the lever 60, to a position shown in FIG. 10, i.e. in which it no longer engages the locking lever 110. Thus, the lever 110 rocks about its pin 112 under the force of the lever 60 out of a locking engagement with the subhousing 66. As a result, the force of the spring 52 acting through the poppet valve head 46 and the stem 44 forces the lever 60 to the position shown in FIG. 9 which causes the gasket 46 to be forced against the valve seat 40 to stop the flow of gasoline and vapor through the housing 10.

After the flow of gasoline has been stopped in the above manner, the operator will remove the spout 20 from the tank, and the tube 30 will relieve the vacuum in chamber 86*a*. Therefore, upon release of the lever 60 by the operator, the pivotal end of the latter will move upwardly under the action of the leaf spring 72 into engagement with the slot in the locking lever 110, and the spring 100 in the passage 84 will force the link 102 into the locking position shown in FIG. 6 so that the vehicle tank may be "topped" and/or the above-mentioned operation repeated.

It is therefore apparent that several advantages result from the foregoing arrangement. For example, use of the passage 80 which is separate from the main gasoline flow passage through the housing is more effective in creating a vacuum in the housing when compared to prior art devices, which therefore renders the device of the present invention more sensitive. Also, the positioning of the relief valve 56 in the main flow passage creates an upstream pressure that insures that a portion of the gasoline will immediately flow through the passage 80 after actuation of the lever 60 to enable the device to respond instantaneously to the presence or absence of fluid in the vehicle tank. In addition to this, the relief valve 56 also functions to prevent the back flow of gasoline through the housing 10.

Further, the use of the locking lever 110 which directly acts on the pivotal end of the valve actuating lever 60 further adds to the sensitivity of the device. Also, the design of the locking lever 110 and its interaction with the lever 60 and the link 102 enables the device to instantly reset with a minimal use of springs and moving parts.

Still further the diaphragm seal 50 cooperating with the poppet valve stem 44 allows the actuating lever to be operated with a relatively low spring pressure which is important not only for operator-dispensing devices but for self service stations, and, in addition, eliminates the need for packing, or the like, and its inherent disadvantages.

An alternative embodiment of the discharge portion of the apparatus of the present invention is shown in FIG. 11. In particular, the rubber bellows sleeve of the previous embodiment is replaced by a metallic sleeve 120 extending over the discharge spout 20 in a coaxial relationship thereto. A plurality of openings 122 are formed through the sleeve 120 for the passage of vapor into an annular passage 124 extending between the spout and a portion of the sleeve, as in the previous embodiment. Of course this arrangement provides a more compact unit which is especially advantageous in self-service installations.

It is understood that the above apparatus is not limited to use in gasoline dispensing installations, but can be used in other environments compatible with the particular operation of the apparatus. Of course, further variations of the specific construction and arrangement of the apparatus disclosed above can be made by those skilled in the art without departing from the invention as defined in the appended claims.

What is claimed:

1. An apparatus for dispensing fluid into a container comprising a housing having an inlet for receiving fluid and an outlet for discharging said fluid, passage means formed in said housing for permitting the flow of fluid from said inlet to said outlet, said passage means comprising a first passage for permitting a direct flow of fluid from said inlet to said outlet and a second passage for receiving a portion of the fluid passing from said inlet to said outlet, means for creating a vacuum zone in said housing in response to the flow of fluid through said second passage, a valve member disposed in said housing and movable in said housing to open said passage, a lever assembly movable relative to said housing between a first position in which it can be manually actuated to move said valve member into said passage-opening position and a second position in which it cannot be manually actuated to move said valve member into said passage-opening position, means disposed in said housing and in engagement with said lever assembly for exerting a first force against said lever assembly to urge said lever assembly to said first position, means responsive to the creation of said vacuum zone for exerting a second force against said lever assembly greater than said first force to urge said lever assembly to said second position, and means associated with said housing for sensing the absence of a predetermined fluid level in said container for relieving said vacuum and said second force so that said lever assembly is urged to said first potition.

2. The apparatus of claim 1, in which said lever assembly comprises a manually actuated first lever pivotally mounted relative to said housing about a point intermediate its ends, a second lever pivotally mounted in said housing for engaging one end of said first lever to establish a second pivot point for said first lever, and a link pivotally mounted relative to said housing for engaging said second lever.

3. The apparatus of claim 2 wherein said second force-exerting means comprising a diaphragm operatively connected to said link and adapted to move in one direction is said housing in response to the creation of said vacuum zone.

4. The apparatus of claim 3 wherein said first force-exerting means comprises resilient means engaging said diaphragm for urging said diaphragm in a direction opposite to said one direction.

5. The apparatus of claim 4, wherein said means for relieving said vacuum comprises a tube mounted relative to said housing and communicating the container to be filled with said vacuum zone to relieve said vacuum in the absence of the liquid level in said container covering the corresponding end of said tube.

6. The apparatus of claim 1, wherein said housing has an additional inlet for receiving vapor, an additional outlet for discharging vapor, and a passage connecting said additional inlet to said additional outlet.

7. The apparatus of claim 6, wherein said fluid inlet and said vapor outlet are disposed at one end of said housing and said vapor inlet and fluid outlet are disposed at the other end of said housing.

8. An apparatus for dispensing fluid into a container comprising: a housing having an inlet for receiving fluid and an outlet for discharging said fluid, passage means formed in said housing for permitting the flow of fluid from said inlet to said outlet, said passage means comprising a first passage for permitting a direct flow of fluid from said inlet to said outlet and a second passage for receiving a portion of the fluid passing from said inlet to said outlet, an eductor formed in said second passage for creating a vacuum zone in response to the flow of fluid through said second passage, operating means disposed in said housing and normally biased into a position to close said passage means, said operating means being manually actuatable to open said passage means, and means responsive to the creation of said vacuum zone for preventing manual actuation of said operating means.

9. The apparatus of claim 8 further comprises means for sensing the absence of a predetermined fluid level in said container for relieving said vacuum to permit manual actuation of said operating means.

10. The apparatus of claim 8 wherein said operating means comprises a valve member, spring means biasing said valve member into a passage closing position, and manually actuatable lever means adjusted to engage said valve member to move said valve member to said passage opening position.

11. The apparatus of claim 8, further comprising a relief valve disposed in said first passage for permitting fluid flow through said first passage only after a predetermined fluid pressure is established that acts on said valve.

12. A fluid dispensing apparatus comprising a housing having an inlet for receiving fluid, and outlet for discharging said fluid and a passage for permitting the flow of fluid from said inlet to said outlet; and means disposed in said housing for controlling the flow of fluid through said housing, said means comprising partition means disposed in said housing and defining a valve seat and a bore, a poppet valve member having a stem slidably mounted in said bore and a head adapted to engage said seat, means urging said head into engagement with said seat to prevent the flow of fluid through said housing, manually actuated lever means mounted relative to said housing for actuating said valve member to move said head out of engagement with said seat to permit the flow of fluid through said passage, and a diaphragm seal extending across said bore and secured to said partition means and to said stem for movement with said stem to prevent fluid leakage through said bore.

13. The apparatus of claim 12, wherein said diaphragm seal is disc-shaped and is secured along its outer peripheral portion between two abutting surfaces of said partition means and along its central portion between two abutting surfaces of said stem.

14. An apparatus for dispensing fluid into a container, comprising a housing having an inlet for receiving fluid and an outlet for discharging said fluid, passage means formed in said housing for permitting the flow of fluid from said inlet to said outlet, a valve member disposed in said housing, a spring normally biasing said valve member into a position to close said passage, a subhousing pivotally mounted relative to said housing, an actuating lever pivotally mounted relative to said subhousing and adapted to engage said valve member, a locking lever engaging said subhousing for permitting pivotal movement of said lever relative to said subhousing to move said valve member against the force of said spring to open said passage, and means associated with said housing for sensing the existence of a predetermined fluid level in said container for permitting the locking lever to release its engagement with said subhousing and prevent pivotal movement of said lever relative to said subhousing.

15. The apparatus of claim 14, wherein upon release of the engagement of said locking lever with said subhousing, said spring urges said subhousing and said actuating lever away from said locking lever.

16. The apparatus of claim 15, further comprising a leaf spring cooperating with said subhousing for urging said subhousing towards said locking lever after manual actuation of said locking lever is terminated.

17. The apparatus of claim 16, wherein said locking lever re-engages said subhousing under the action of said leaf spring in the absence of said predetermined fluid level.

* * * * *